US007237370B1

(12) United States Patent
Garone et al.

(10) Patent No.: US 7,237,370 B1
(45) Date of Patent: Jul. 3, 2007

(54) MANUAL METHOD TO TRANSFORM A DIAPER

(76) Inventors: Lynn Garone, 22 Roxton Rd., Plainview, NY (US) 11803; LeeAnn Piazzola, 16 Giffard Way, Melville, NY (US) 11747; Lori Wallace, 34 Chivalry La., Nesconset, NY (US) 11767

( * ) Notice: Subject to any disclaimer, the term of this patent is extended or adjusted under 35 U.S.C. 154(b) by 8 days.

(21) Appl. No.: 11/201,669

(22) Filed: Aug. 12, 2005

(51) Int. Cl.
*B65B 63/04* (2006.01)
*B65B 31/02* (2006.01)

(52) U.S. Cl. ..... 53/429; 53/434; 206/494; 604/385.201

(58) Field of Classification Search ..... 53/429, 53/434

See application file for complete search history.

(56) References Cited

U.S. PATENT DOCUMENTS

| | | | | |
|---|---|---|---|---|
| 3,516,217 | A * | 6/1970 | Gildersleeve | 53/399 |
| 3,521,424 | A * | 7/1970 | Wirfel | 53/419 |
| 3,537,226 | A * | 11/1970 | Le Van et al. | 53/430 |
| 4,928,829 | A * | 5/1990 | Di Bernardo | 206/524.8 |
| 5,175,977 | A * | 1/1993 | Crawford et al. | 53/399 |
| 5,878,551 | A * | 3/1999 | Curley et al. | 53/434 |
| 2003/0183550 | A1* | 10/2003 | DiLiberto, Jr. | 206/524.8 |
| 2004/0168947 | A1 | 9/2004 | McDonald | |
| 2005/0138894 | A1* | 6/2005 | Snell | 53/412 |
| 2006/0201112 | A1* | 9/2006 | Corlett | 53/432 |

* cited by examiner

*Primary Examiner*—John Sipos
(74) *Attorney, Agent, or Firm*—Myrons Amer P.C.

(57) ABSTRACT

A method transforming by eliminating with vacuum bulk and size of a marketplace diaper to a substantially size-reduced condition, preparatory to a traveled-to site of use, wherein the reduced size adds to convenience value during the travel.

1 Claim, 5 Drawing Sheets

Fig. 1
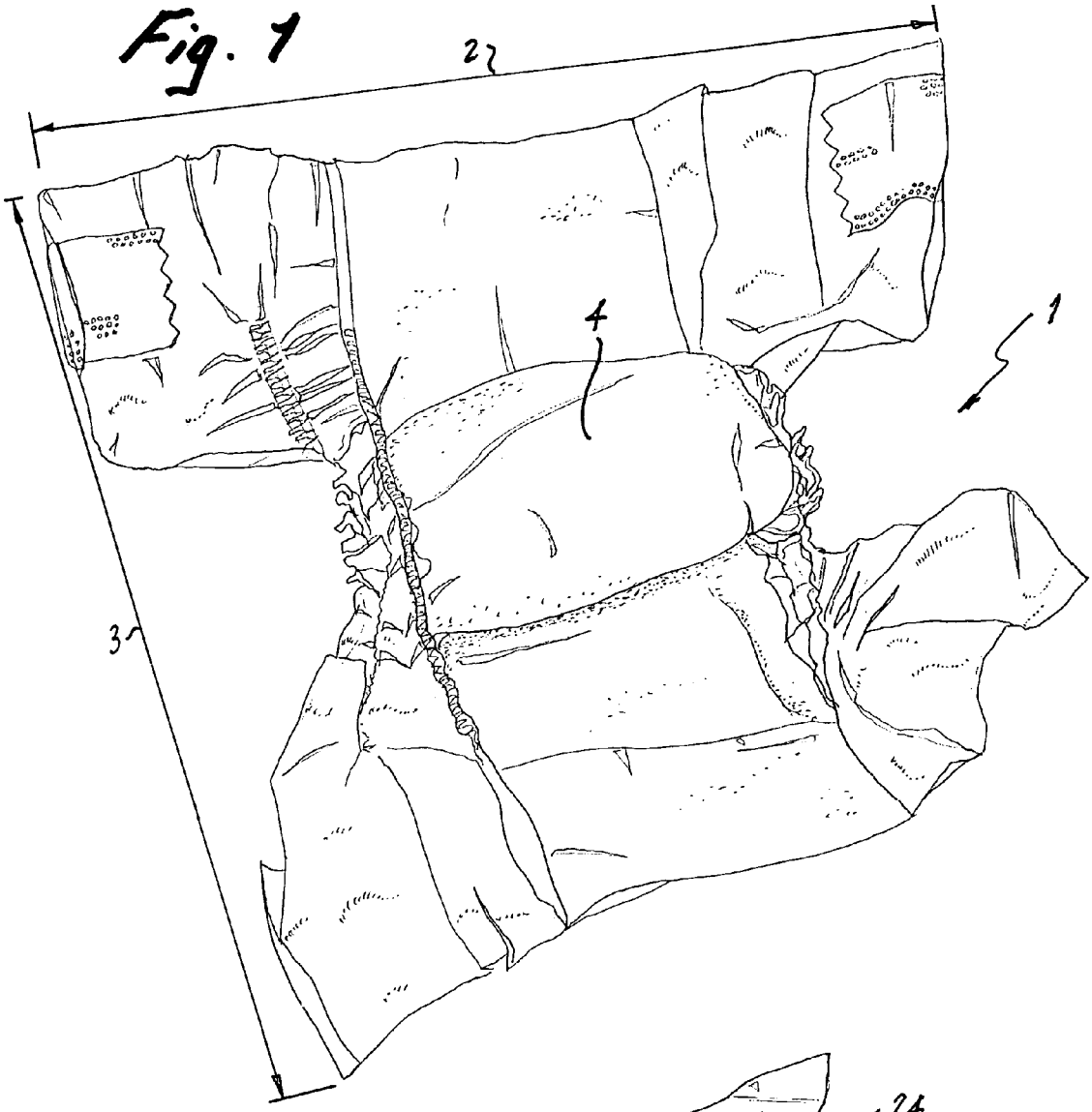
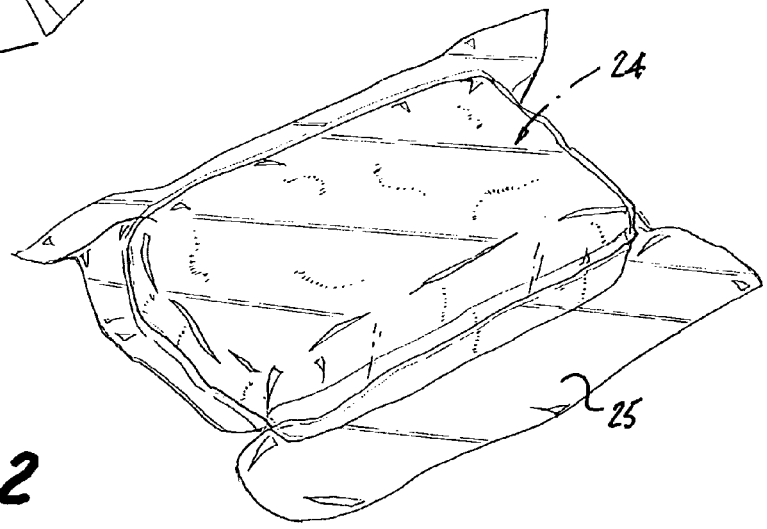
Fig. 2

MANUAL METHOD TO TRANSFORM A DIAPER

The present invention relates generally to improvements in a disposable infant diaper, the improvements more particularly being applied manually to the diaper by a user thereof, i.e. a parent or care giver, to the end of facilitating the use of the diaper other than at home, but at a site of use requiring travel and transport of the diaper.

EXAMPLE OF THE PRIOR ART

As an article of manufacture, a disposable diaper is constituted of a size, typically correlated to an infant's size at months of age of a triangular shape eleven inches by thirteen inches and having the bulk of a central absorbent pad. As a consequence, the diaper size and bulk is inconvenient to transport to a site of use away from home and in recognition of this drawback, a diaper manufacturer, as exemplified by Kimberly-Clark Worldwide, Inc. of Neenah, Wis. 54956, has published a reduced sized configurated diaper in U.S. patent application Pub. No. US 2004/0168947 A1 for "Packaging with Easy Open Feature" of Duane L. McDonald on Sep. 2, 2004.

The referred to reduced-sized configurated diaper is unattractive in its appearance, and it is believed this is the reason it is not displayed for purchase in supermarkets and other retail outlets, and thus is not available for use, notwithstanding its noteworthy utility for travel unencumbered by excessive size and bulk.

Broadly, it is an object of the present invention to overcome the foregoing and other shortcomings of the prior art.

More particularly, it is an object to enable a parent or caregiver to purchase a commercially available disposable diaper and to manually transform the purchased diaper at home to a significantly reduced-sized configuration for transit, and thus using self-help to achieve what should be but is not yet in the marketplace.

The description of the invention which follows, together with the accompanying drawings should not be construed as limiting the invention to the example shown and described, because those skilled in the art to which this invention appertains will be able to devise other forms thereof within the ambit of the appended claims.

FIG. 1 is a view in the flat of a commercially available infant diaper transformed from the size and shape illustrated to a size and shape contributing to transit thereof;

FIG. 2 is a view of the diaper of FIG. 1 transformed into the transit condition thereof according to the manual method of the present invention;

Figure 3:
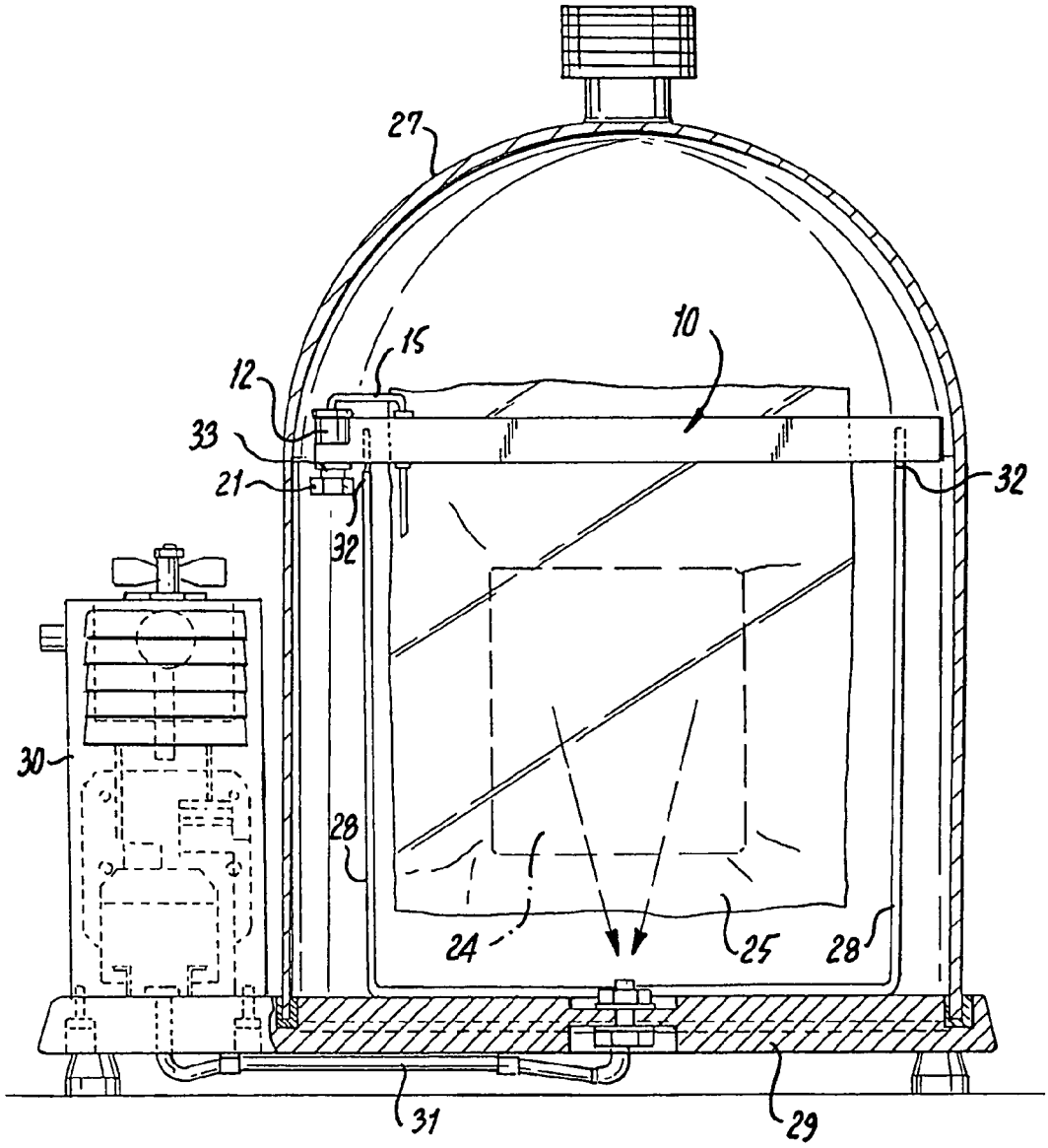
Fig. 3 (Prior Art)
FIG. 3 is a plan view of a device for practicing the method subsets D and E of the diaper-transforming method hereof.
Figure 4:
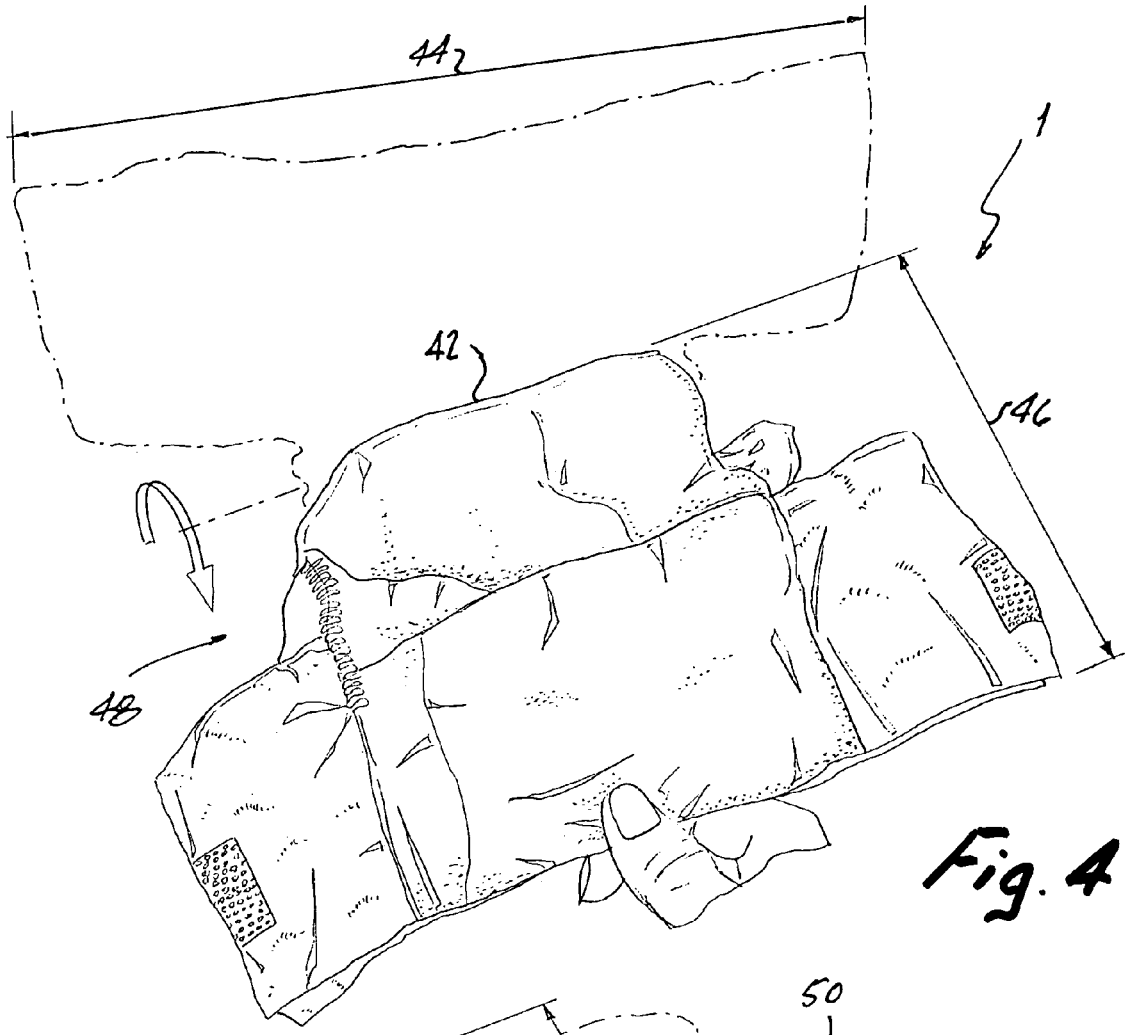
FIG. 4 illustrates the practicing of the claimed method subset B(1)
Figure 5:
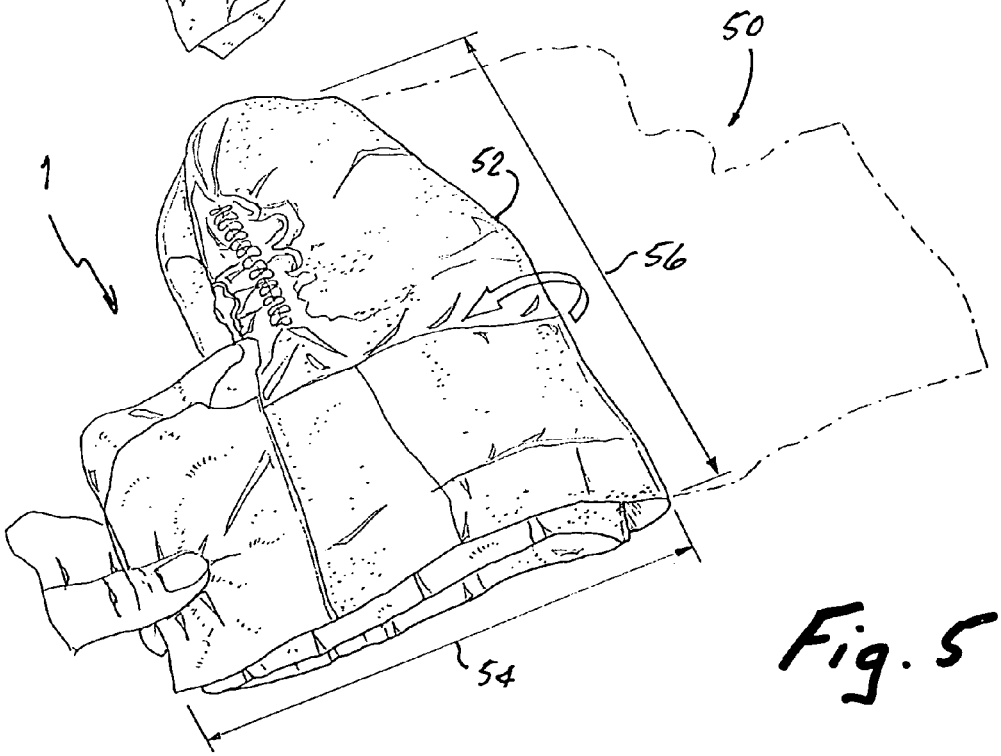
FIG. 5 illustrates the practicing of the claimed method subset B(2)
Figure 6:
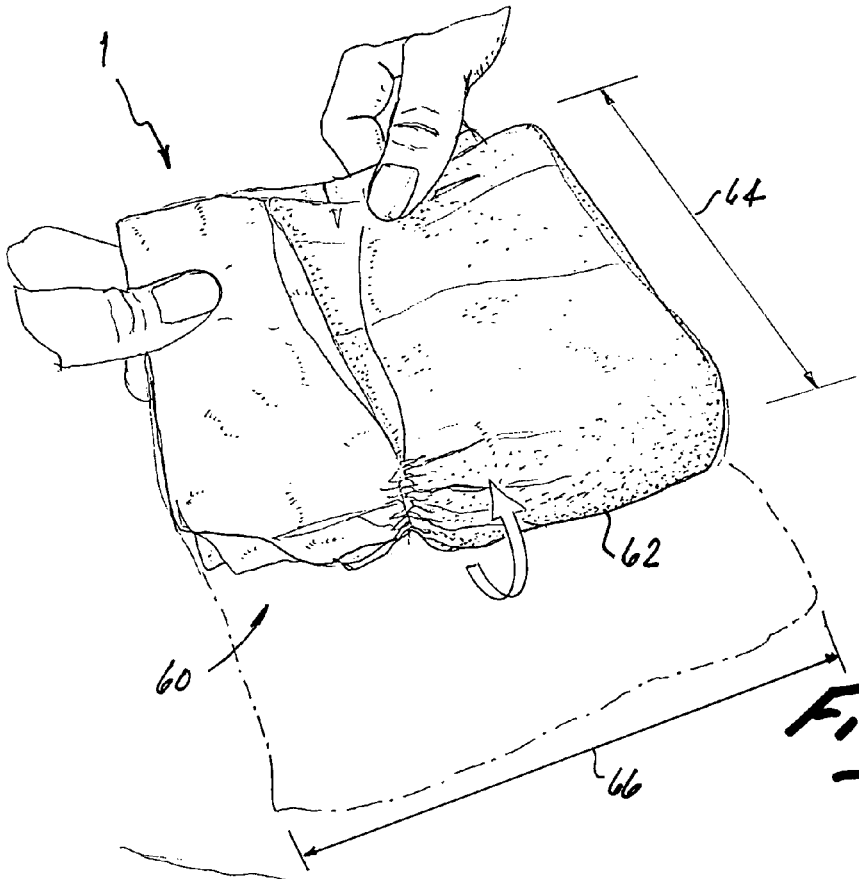
FIG. 6 illustrates the practicing of the claimed method subset B(3)

As known from common experience, in infant care the indispensable diaper has undergone significant changes in its usage, as mainly dictated by improvements in its construction material. For example, substituted for cloth requiring a diaper "service" for the laundering thereof, has been a relatively inexpensive non-woven constituted article of manufacture that is disposable. Available from several suppliers, the disposable diaper, generally designated 1 in FIG. 1, is sized generally correlated to the typical size at months of age of an infant, and for the within disclosure is to be understood to have a generally triangular shape in the flat as illustrated in FIG. 1 with a width expanse 2 of approximately eleven inches, a largest length expanse 3 of approximately thirteen inches, and a centrally located adhesively attached absorbent pad 4. A drawback of the disposability attribute of the FIG. 1 diaper 1 is its correspondingly excessive bulk and size rendering it inconvenient to be carried by the care giver to a site of use outside the home, a contingency often occurring.

Addressing the drawback noted, the present invention enables the modifying of the diaper configuration of FIG. 1 to the significantly reduced rectangular size illustrated in FIG. 2, measuring approximately in width of approximately three inches and in length of approximately three inches, achieved primarily manually at the home of the care giver, or other designated individual, preparatory to travel with the infant, all as will be better understood as the description proceeds.

As a starting point of such description, reference is made to FIG. 3 illustrating what has been selected from a category of commercially available apparatus used for size and shape modification of food products using a vacuum operating mode, and used in the present circumstances to achieve the transformation of the diaper 1 from its condition illustrated in FIG. 1 to its condition illustrated in FIG. 2.

Referring to FIG. 3, the illustrated device generally designated 10 is constituted as a clamp comprising a pair of rod-shaped jaws which are pivotally hinged to each other in correspondence of one of their ends by means of a pivot 12.

The folded FIG. 1 diaper 24 in a bag 25 of plastic construction material is placed with an edge thereof in correspondence of its open side between the jaws of the clamp 10, with the operator being careful of inserting inside the same envelope the suction pipe 15, after which the clamp 10 can be tightened, so as to achieve a tight sealing of the bag 25.

The bag 25 provided with the clamp 10 can be connected to a vacuum source constituted either by a traditional vacuum "bell", or by a pump, the intake duct of which is connected with the screw-threaded fitting 21 of the pipe 15.

In this way, it clearly appears that the air contained inside the bag 25 can be evacuated within very short times, through the suction pipe 15, after which the bag 25, equipped with the clamp 10, can be disconnected from the vacuum source.

As shown in FIG. 3, inside the bell 27 a bracket support 28 can be provided by simply leaning the relevant clamps on bars 32 provided at the top of the support 28.

The bell 27 is placed, with tight sealing, on a base 29 which also laterally bears a vacuum pump 30 of a per se known type, herein not disclosed in greater detail.

The intake end of the pump 30 is connected with the interior of the bell 27 by means of a duct 31, and the same pump 30 is provided with a fitting 33 with which the screw-threaded fitting 21 can be connected through an auxiliary duct, in order to generate vacuum inside a single envelope outside the bell 27. The bagged diaper 24, 25 is thus transformed to the condition of FIG. 2.

Manual folding of the FIG. 1 diaper 1 is contemplated by the present invention preparatory to the insertion thereof into the bag 25 and to the processing of the bagged diaper in the device 10 of FIG. 3, and is best understood from reference in sequence to drawing FIGS. 4, 5, 6 and 7.

Diaper 1 is manually first folded in its length expanse upon itself, as at 42, into approximately a ten-inch width 44 and a seven-inch length 46 rectangular configurated size 48. See FIG. 4.

Next, there is a manually second folding in the width expanse 50 upon itself, as at 52, into approximately a five-inch width 54 and a seven-inch length 56, second smaller configurated size 58. See FIG. 5.

A manually third folding is applied to the length expanse 60 upon itself, as at 62, into approximately a five-inch width 64 and a four-inch length 66, to provide an additionally reduced-size configurated shape 68. See FIG. 6.

Figure 7:
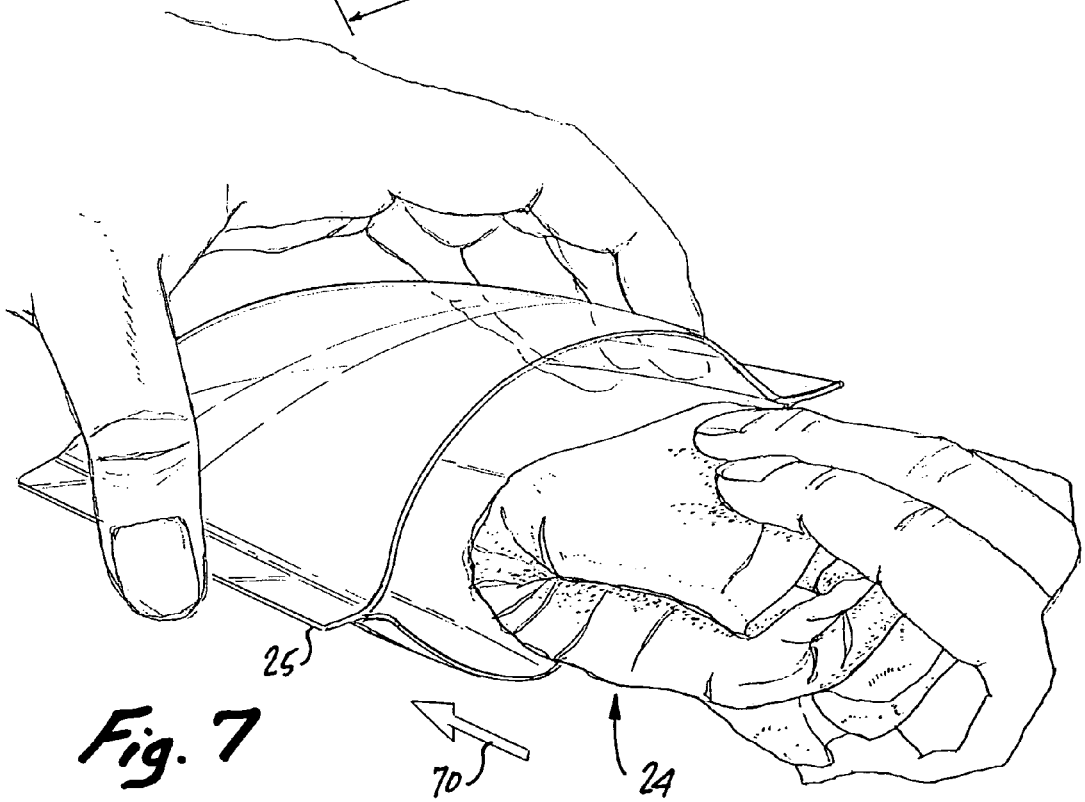
FIG. 7 illustrates the practicing of the claimed method subset C.

The thusly folded diaper 24, in its prepared manually sized-reduced condition, is manually inserted, as noted at 70 in FIG. 7, into a plastic bag 25.

Figure 8:
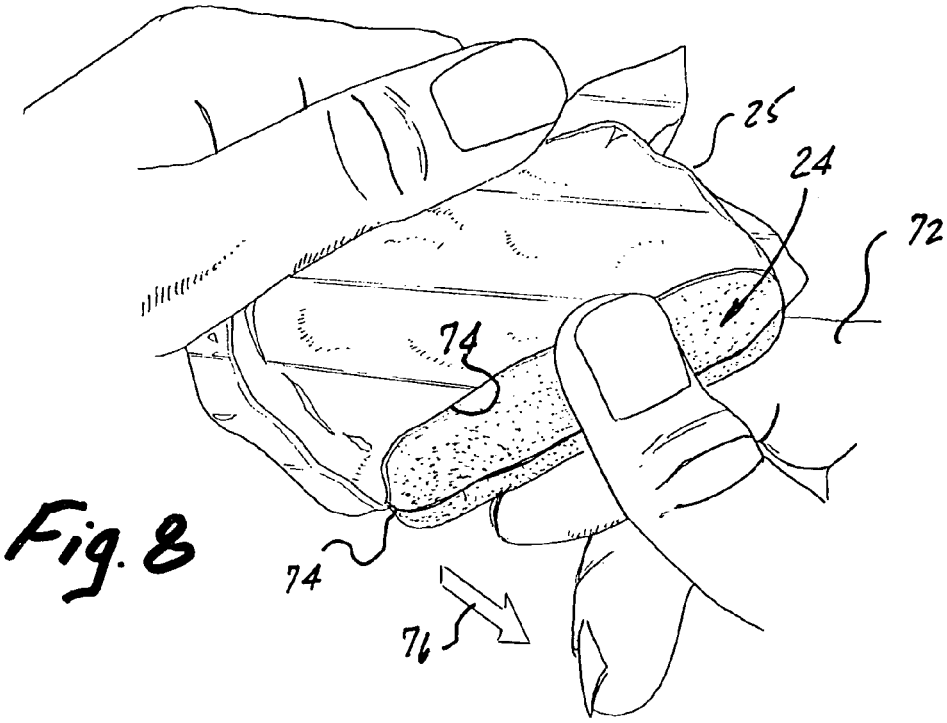
FIG. 8 illustrates the practicing of the claimed method subset F.
Figure 9:
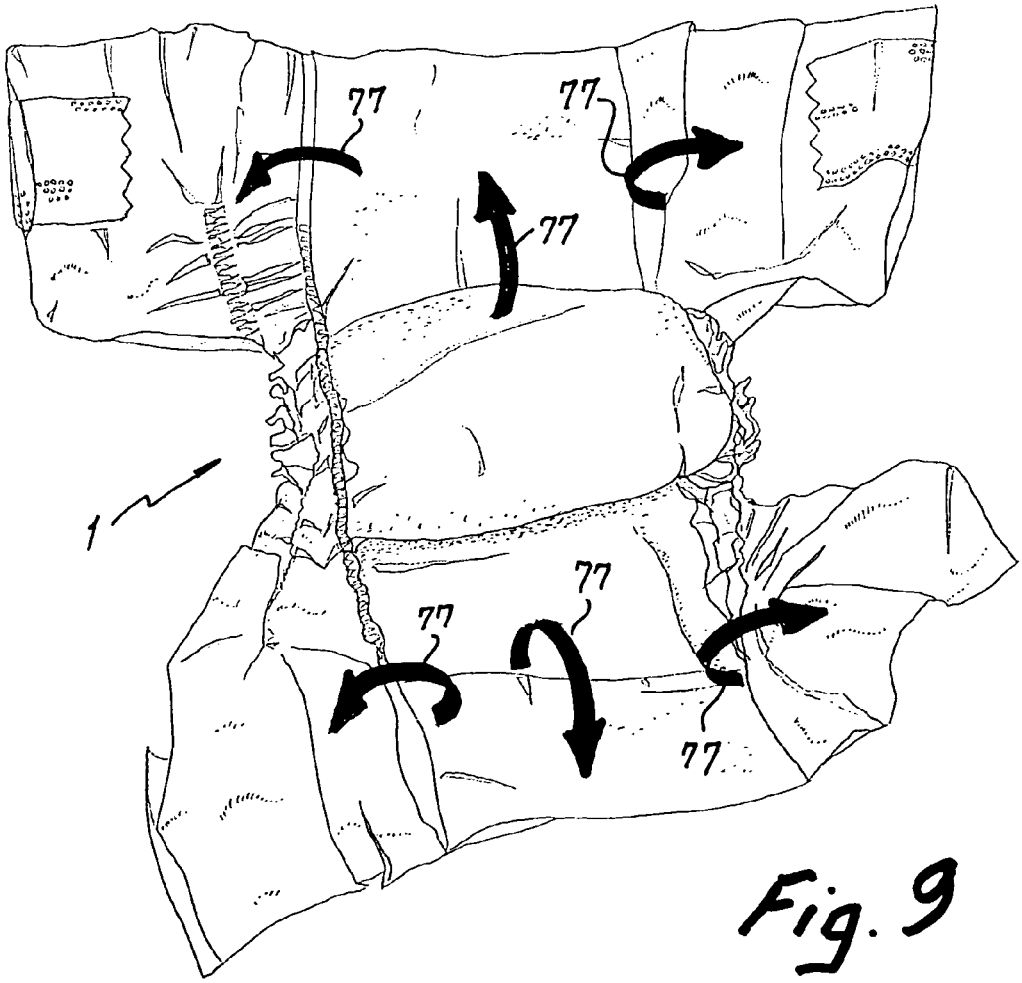
FIG. 9 illustrates the practicing of the claimed method subset G.

The completion of the diaper-transforming method hereof and of its utilitarian use is disclosed by arrow 76 in FIG. 8 and arrows, individually and collectively designated 77, in FIG. 9.

After transport to a site of use, which was unencumbered by bulk and size handling of the diaper of FIG. 1 during transit or travel thereto, the user 72 opens at least one sealed together cooperating edges 74, and removes, as noted at 76, the bag contents, which is a three inch by three inch shape 3, 6, and readily unfolds the shape into the size and shape of eleven inches 2 by thirteen inches 3 as commercially purchased.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A manual method to transform an infant diaper to enhance the transport thereof comprising the steps of:

A. purchasing a commercially available non-factory vacuumed packaged readily foldable rectangular shaped diaper in the flat of a size not in excess of eleven inches in width nor in excess of thirteen inches in length and of bulky water-absorbent cloth construction material located in a medial area thereof;

B. transforming said diaper preparatory to effectuate an enhanced condition contributing to portability thereof by;

(1) manually folding said length upon itself and said width upon itself into approximately a ten inch width and seven inch length rectangular configurated size;

(2) manually subsequently folding said aforesaid folded length in width again upon itself into approximately a five inch width and seven inch length rectangular configurated size; and (3) manually third subsequently folding said aforesaid folded in length upon itself diaper into approximately a five inch width and four inch length rectangular configurated size;

C. manually inserting said transformed diaper into a package of flexible plastic construction material;

D. withdrawing by vacuum means the air content of said package contributing to a size reduction in a rectangular shape of approximately three inches by three inches;

E. heat sealing peripheral overlapping edges of said package;

F. transporting said diaper to a site of use;

G. opening at least one sealed together cooperating edges;

H. removing said three inches by three inches shape; and

I. unfolding said removed three inches by three inches shape into said purchased commercially available eleven inches by thirteen inches size;

whereby the diaper is used at said site of use unencumbered by bulk and size handling of the diaper during the transport thereto.

* * * * *